US010914498B2

(12) United States Patent
Hu et al.

(10) Patent No.: US 10,914,498 B2
(45) Date of Patent: Feb. 9, 2021

(54) HEAT PUMP SYSTEM

(71) Applicant: SANHUA (HANGZHOU) MICRO CHANNEL HEAT EXCHANGER CO., LTD., Hangzhou (CN)

(72) Inventors: Lei Hu, Hangzhou (CN); Qiang Gao, Hangzhou (CN); Jing Zhou, Hangzhou (CN); Xiaoming Zhong, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 258 days.

(21) Appl. No.: 15/775,826

(22) PCT Filed: Nov. 10, 2016

(86) PCT No.: PCT/CN2016/105365
§ 371 (c)(1),
(2) Date: May 12, 2018

(87) PCT Pub. No.: WO2017/084533
PCT Pub. Date: May 26, 2017

(65) Prior Publication Data

US 2018/0328632 A1 Nov. 15, 2018

(30) Foreign Application Priority Data

Nov. 18, 2015 (CN) ..... 2015 1 0796839

(51) Int. Cl.
*F25B 30/00* (2006.01)
*F25B 30/02* (2006.01)
(Continued)

(52) U.S. Cl.
CPC ..... *F25B 30/02* (2013.01); *F25B 13/00* (2013.01); *F25B 30/00* (2013.01); *F25B 39/00* (2013.01);
(Continued)

(58) Field of Classification Search
CPC .. F25B 13/00; F25B 2013/0253; F25B 30/00; F25B 30/02; F25B 41/046;
(Continued)

(56) References Cited

U.S. PATENT DOCUMENTS 4,313,313 A * 2/1982 Chrostowski ..... F25B 13/00 62/196.4
4,420,947 A * 12/1983 Yoshino ..... G05D 23/1917 62/160
(Continued)

FOREIGN PATENT DOCUMENTS

CN 101122435 A 2/2008
CN 102252464 A 11/2011
(Continued)

OTHER PUBLICATIONS

International Search Report and Written Opinion of the International Searching Authority for PCT International Application No. PCT/CN2016/105365 dated Feb. 9, 2017.
(Continued)

*Primary Examiner* — Filip Zec
(74) *Attorney, Agent, or Firm* — Howard & Howard Attorneys PLLC

(57) ABSTRACT

A heat pump system includes a compressor, a four-way valve, an outdoor heat exchanger, a throttling device and an indoor heat exchanger connected in sequence to form a refrigerant main circuit. The outdoor heat exchanger includes at least one double-rowed heat exchanger. The heat pump system has a cooling mode and a heating mode, and
(Continued)

further includes a switching unit. The switching unit is connected in the refrigerant main circuit, and switches a flow direction of a refrigerant, such that the refrigerant flows into the outdoor heat exchanger through one of the first heat exchanger and the second heat exchanger, and flows out of the outdoor heat exchanger through the other one of the first heat exchanger and the second heat exchanger both in the cooling mode and in the heating mode.

20 Claims, 5 Drawing Sheets

(51) Int. Cl.

| | |
|---|---|
| ***F25B 39/00*** | (2006.01) |
| ***F28D 1/047*** | (2006.01) |
| ***F25B 13/00*** | (2006.01) |
| ***F25B 41/04*** | (2006.01) |

(52) U.S. Cl.
CPC ..... *F25B 41/046* (2013.01); *F28D 1/0475* (2013.01); *F25B 2313/0253* (2013.01); *F25B 2500/01* (2013.01)

(58) Field of Classification Search
CPC .... F25B 2313/0251; F25B 2313/02791; F25B 2313/025
See application file for complete search history.

(56) References Cited

U.S. PATENT DOCUMENTS

| | | | | | |
|---|---|---|---|---|---|
| 4,493,193 | A * | 1/1985 | Fisher | F24D 11/0214 | 62/160 |
| 5,186,016 | A * | 2/1993 | Nigo | F24F 11/00 | 62/150 |
| 5,771,699 | A * | 6/1998 | Ponder | F25B 13/00 | 62/81 |
| 6,978,630 | B2 * | 12/2005 | Wensink | B60H 1/00364 | 62/175 |
| 9,261,297 | B2 * | 2/2016 | Guldali | F25B 5/04 | |
| 9,719,691 | B2 * | 8/2017 | Takenaka | F25B 13/00 | |
| 10,260,785 | B2 * | 4/2019 | Yang | F25B 13/00 | |
| 2011/0192181 | A1 * | 8/2011 | Yi | F25B 13/00 | 62/160 |
| 2015/0059392 | A1 * | 3/2015 | Chi | F25B 41/04 | 62/324.6 |
| 2015/0292789 | A1 * | 10/2015 | Takenaka | F25B 47/022 | 62/140 |

FOREIGN PATENT DOCUMENTS

| | | | | |
|---|---|---|---|---|
| CN | 202101340 | U | 1/2012 | |
| CN | 103134235 | A | 6/2013 | |
| CN | 103307801 | A | 9/2013 | |
| CN | 103822401 | A | 5/2014 | |
| CN | 103913017 | A | 7/2014 | |
| FR | 971034 | A | 1/1951 | |
| JP | H04187990 | A | 7/1992 | |
| JP | 2001059664 | A | 3/2001 | |
| WO | WO-2012159475 | A1 * | 11/2012 | F25B 13/00 |

OTHER PUBLICATIONS

Communication dated Jun. 19, 2019 enclosing the Extended European Search Report dated Jun. 11, 2019 for European Patent Application No. 16865710.4.
First Office Action for Chinese Patent Application No. 2015107968395 dated Nov. 2, 2018.

* cited by examiner

HEAT PUMP SYSTEM

CROSS-REFERENCE TO RELATED APPLICATIONS

The present application is a U.S. National Phase application under 35 USC § 371 of the International Patent Application No. PCT/CN2016/105365, filed on Nov. 10, 2016, which claims the benefit of prior Chinese Application No. 201510796839.5, filed with the State Intellectual Property Office of P. R. China on Nov. 18, 2015. The entire contents of the before-mentioned patent applications are incorporated by reference as part of the disclosure of this U.S. application.

BACKGROUND OF THE INVENTION

1. Field of the Invention

The present disclosure relates to a technical field of heat exchange, and more particularly to a heat pump system.

2. Description of the Related Art

A commercial air-cooled conditioning unit in the related art is generally composed of a plurality of modules. Each module generally includes at least two sheets of heat exchangers in parallel, and in order to improve a heat exchange area, each heat exchanger is arranged to be double-rowed.

When the heat pump system is switched between a cooling mode and a heating mode, a flow direction of a refrigerant in the double-rowed heat exchanger is changed as well. Since a flow direction of air is not changed, heat exchange effects of the heat exchanger in the cooling mode and in the heating mode are different, such that optimization cannot be achieved in both modes, thereby influencing properties of the heat pump system.

SUMMARY OF THE INVENTION

The present disclosure is made on basis of discoveries of inventors of the present disclosure about following facts and problems.

In the related art, a heat exchanger of each module in a heat pump system is usually configured to include double rows (i.e., a first heat exchanger and a second heat exchanger) in series with each other. For example, supposing when the heat pump system operates in a cooling mode, a refrigerant enters the first heat exchanger firstly, and then flows out of the second heat exchanger; when the heat pump system operates in the heating mode, the refrigerant enters the second heat exchanger firstly, and then flows out of the first heat exchanger.

No matter whether in the cooling mode or in the heating mode, the air exchanges heat with the refrigerant in the second heat exchanger firstly, and then exchanges heat with the refrigerant in the first heat exchanger. Since a flow direction of the air is always constant, a heat exchange sequence of the air with the refrigerant in the first heat exchanger and the second heat exchanger in the cooling mode is different from a heat exchange sequence of the air with the refrigerant in the first heat exchanger and the second heat exchanger in the heating mode. In other words, in the cooling mode, the flow direction of the air is opposite to the flow direction of the refrigerant (i.e., the air and the refrigerant has a countercurrent flow exchange heat therebetween), and in the heating mode, the flow direction of the air is the same with the flow direction of the refrigerant (i.e., the air and the refrigerant flow has a parallel flow exchange heat therebetween).

It is found by the inventors of the present disclosure through a lot of research that, the heat exchange effect in the case that the flow direction of the air is opposite to the flow direction of the refrigerant is better than the heat exchange effect in the case that the flow direction of the air is the same with the flow direction of the refrigerant. Therefore, the heat pump system in the related art cannot achieve the best heat exchange effects both in the cooling mode and in the heating mode at the same time, so that there is a need for improvements.

The present disclosure seeks to solve one of the above technical problems in the related art to some extent. For that reason, the present disclosure provides a heat pump system. The heat pump system enhances the heat exchange capacity of the heat exchanger, improves the heat exchange efficiency, and can achieve the optimal heat exchange effects both in the cooling mode and in the heating mode, thereby improving the properties of the heat pump system.

The heat pump system according to embodiments of the present disclosure includes a compressor, a four-way valve, an outdoor heat exchanger, a throttling device and an indoor heat exchanger connected in sequence to form a refrigerant main circuit, in which the outdoor heat exchanger includes at least one double-rowed heat exchanger, the double-rowed heat exchanger includes a first heat exchanger and a second heat exchanger connected in series with each other, an included angle $\alpha$ between the first heat exchanger and the second heat exchanger is larger than or equal to 0 degree and smaller than 180 degrees; the heat pump system has a cooling mode and a heating mode, and also includes a switching unit, the switching unit is connected in the refrigerant main circuit, and switches a flow direction of a refrigerant, such that the refrigerant flows into the outdoor heat exchanger through one of the first heat exchanger and the second heat exchanger, and flows out of the outdoor heat exchanger through the other one of the first heat exchanger and the second heat exchanger both in the cooling mode and in the heating mode.

The heat pump system according to embodiments of the present disclosure uses the switching unit to control the flow direction of the refrigerant in the outdoor heat exchanger, such that there exists the countercurrent flow heat exchange between the refrigerant in the outdoor heat exchanger and the air both in the cooling mode and in the heating mode, thus improving the heat exchange efficiency of the outdoor heat exchanger, ensuring heat exchange effects of the heat pump system to be optimal both in the cooling mode and in the heating mode, thereby improving the heat exchange capacity and the heat exchange efficiency of the heat pump system.

Additional aspects and advantages of embodiments of present disclosure will be given in part in the following descriptions, become apparent in part from the following descriptions, or be learned from the practice of the embodiments of the present disclosure.

REFERENCE NUMERALS

Figure 1:
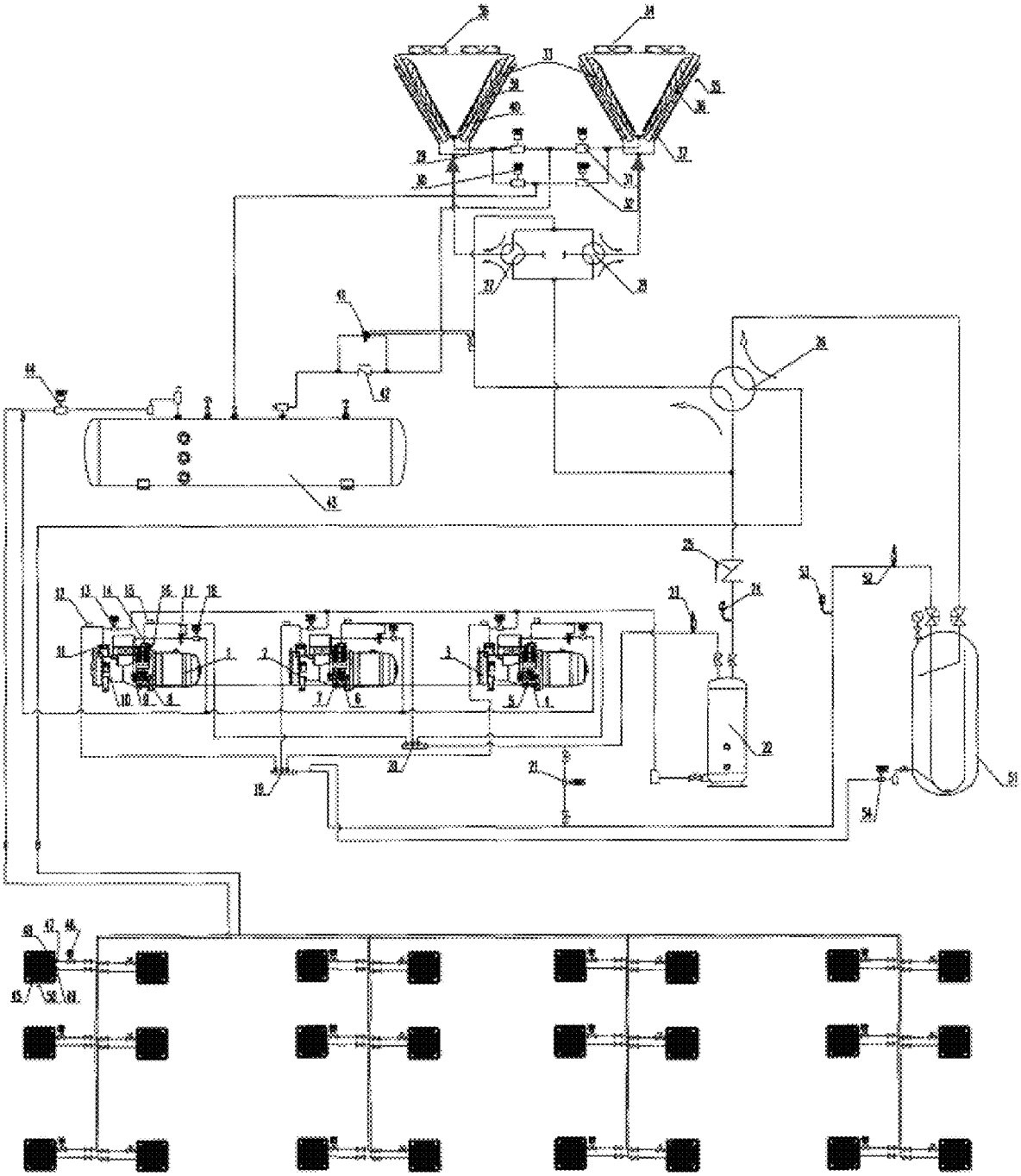
FIG. 1 is a principle diagram schematically illustrating a countercurrent flow heat exchange between a refrigerant in a double-rowed heat exchanger of a conventional heat pump system and air in a cooling mode.

Related art: heat exchanger 31', first heat exchanger 311', first port 31*a*', second heat exchanger 312', second port 31*b*', Present disclosure: heat pump system 100, compressor 1, four-way valve 2, first port 21, second port 22, third port 23, fourth port 24, outdoor heat exchanger 3, double-rowed heat exchanger 31, first heat exchanger 311, first port 31*a*, second heat exchanger 312, second port 31*b*, throttling device 4, indoor heat exchanger 5, first on-off valve 61, second on-off valve 62, third on-off valve 63, fourth on-off valve 64, first refrigerant branch circuit 71, first end 711 of first refrigerant branch circuit 71, second end 712 of first refrigerant branch circuit 71, second refrigerant branch circuit 72, first end 721 of second refrigerant branch circuit 72, second end 722 of second refrigerant branch circuit 72, air flow orientation component 8.

DETAILED DESCRIPTION OF THE INVENTION

Embodiments of the present disclosure will be described in details in the following, and examples of the embodiments are illustrated in accompanying drawings. The same or similar elements and the elements having same or similar functions are denoted by like reference numerals throughout the descriptions. The embodiments described herein with reference to drawings are explanatory, and used to generally understand the present disclosure. The embodiments shall not be construed to limit the present disclosure.

The present disclosure is made on basis of discoveries of inventors of the present disclosure about the following facts and problems.

Figure 2:
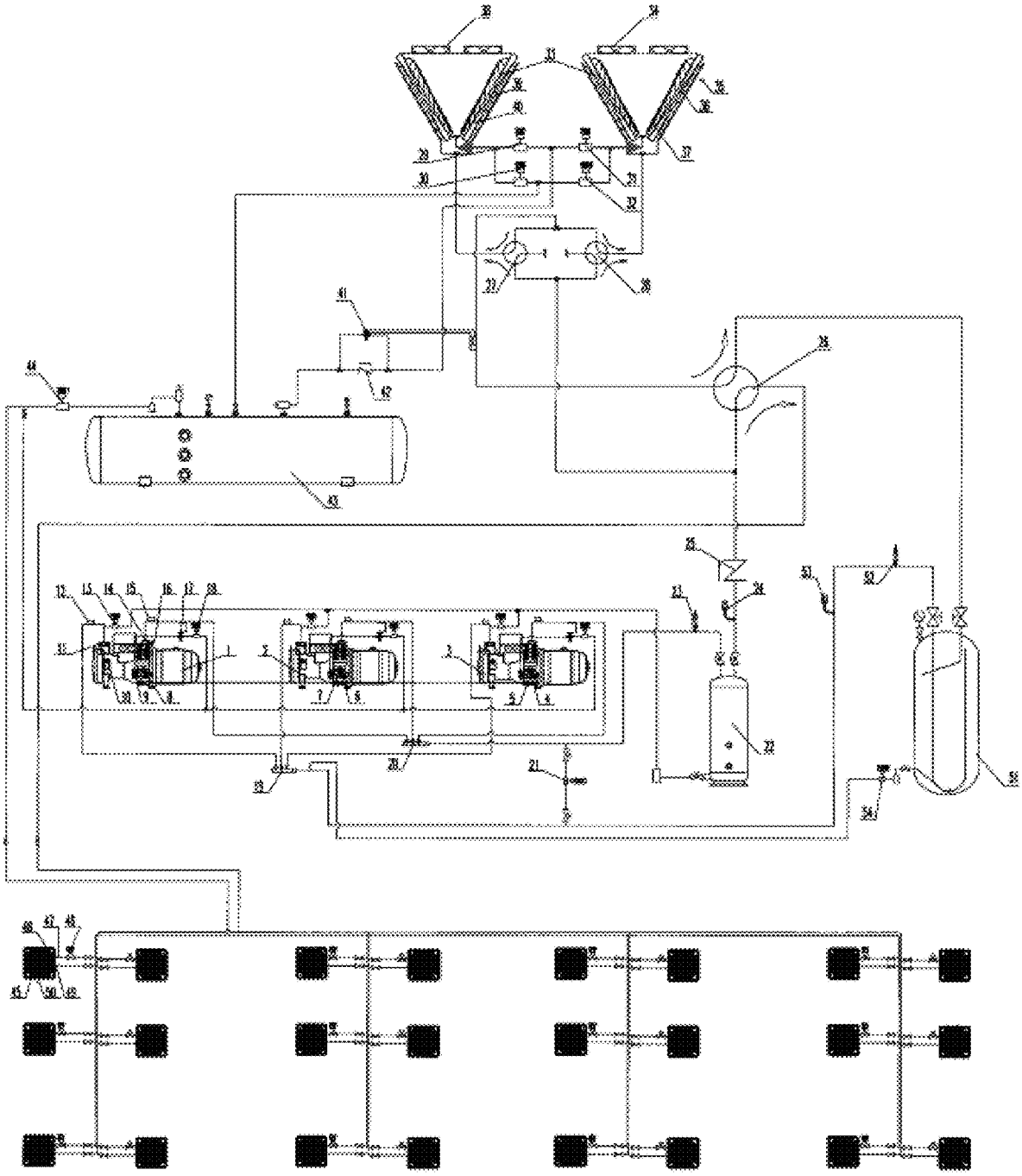
FIG. 2 is a principle diagram schematically illustrating a concurrent flow heat exchange between a refrigerant in a double-rowed heat exchanger of a conventional heat pump system and air in a heating mode.

As illustrated in FIGS. 1-2, in the related art, a heat exchanger 31' of each module in a heat pump system is usually configured to include double rows (i.e., a first heat exchanger 311' and a second heat exchanger 312') in series with each other. For example, as illustrated in FIG. 1, supposing when the heat pump system operates in a cooling mode, the refrigerant enters the first heat exchanger 311' through a first port 31*a*' firstly, and then flows out of the second heat exchanger 312' through a second port 31*b*'; as illustrated in FIG. 2, when the heat pump system operates in a heating mode, a flow direction of the refrigerant changes, the refrigerant enters the second heat exchanger 312' through the second port 31*b*' firstly, and then flows out of the first heat exchanger 311' through the first port 31*a*'. In the drawings, an arrow a denotes a flow direction of air, an arrow b denotes a flow direction of the refrigerant in the first heat exchanger 311', and an arrow c denotes a flow direction of the refrigerant in the second heat exchanger 312'.

No matter whether in the cooling mode or in the heating mode, the air exchanges heat with the refrigerant in the second heat exchanger 312' firstly, and then exchanges heat with the refrigerant in the first heat exchanger 311'. The flow direction of the air is always constant, therefore, in the cooling mode, the flow direction of the air is opposite to the flow direction of the refrigerant (i.e., FIG. 1 illustrates a countercurrent flow heat exchange between the air and the refrigerant), and in the heating mode, the flow direction of the air is the same with the flow direction of the refrigerant (i.e., FIG. 2 illustrates a concurrent flow heat exchange between the air and the refrigerant).

It is found by the inventors of the present disclosure through a lot of research that, the heat exchange effect in the case that the flow direction of the air is opposite to the flow direction of the refrigerant is better than the heat exchange effect in the case that the flow direction of the air is the same with the flow direction of the refrigerant. Therefore, the heat pump system in the related art cannot achieve the best heat exchange effects both in the cooling mode and in the heating mode at the same time, and thus there is a need for improvements.

For that reason, the present disclosure provides a heat pump system 100 with high heat exchange efficiency and good heat exchange properties.

The heat pump system 100 according to embodiments of the present disclosure will be described herein with reference to FIGS. 3-5. The heat pump system 100 can achieve the optimal heat exchange effects both in the cooling mode and in the heating mode at the same time.

Figure 3:
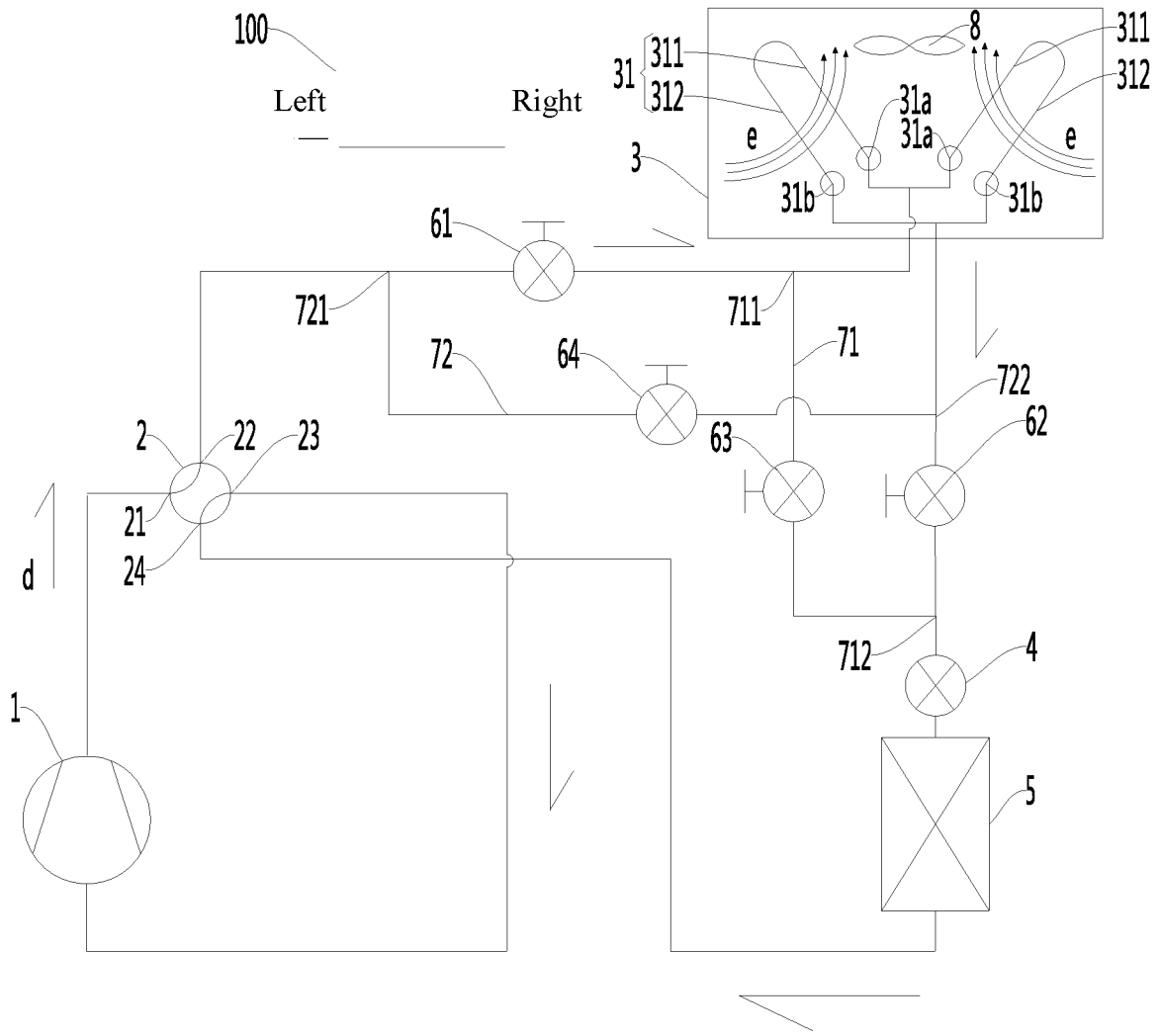
FIG. 3 is a principle diagram of a heat pump system in a cooling mode according to embodiments of the present disclosure.
Figure 4:
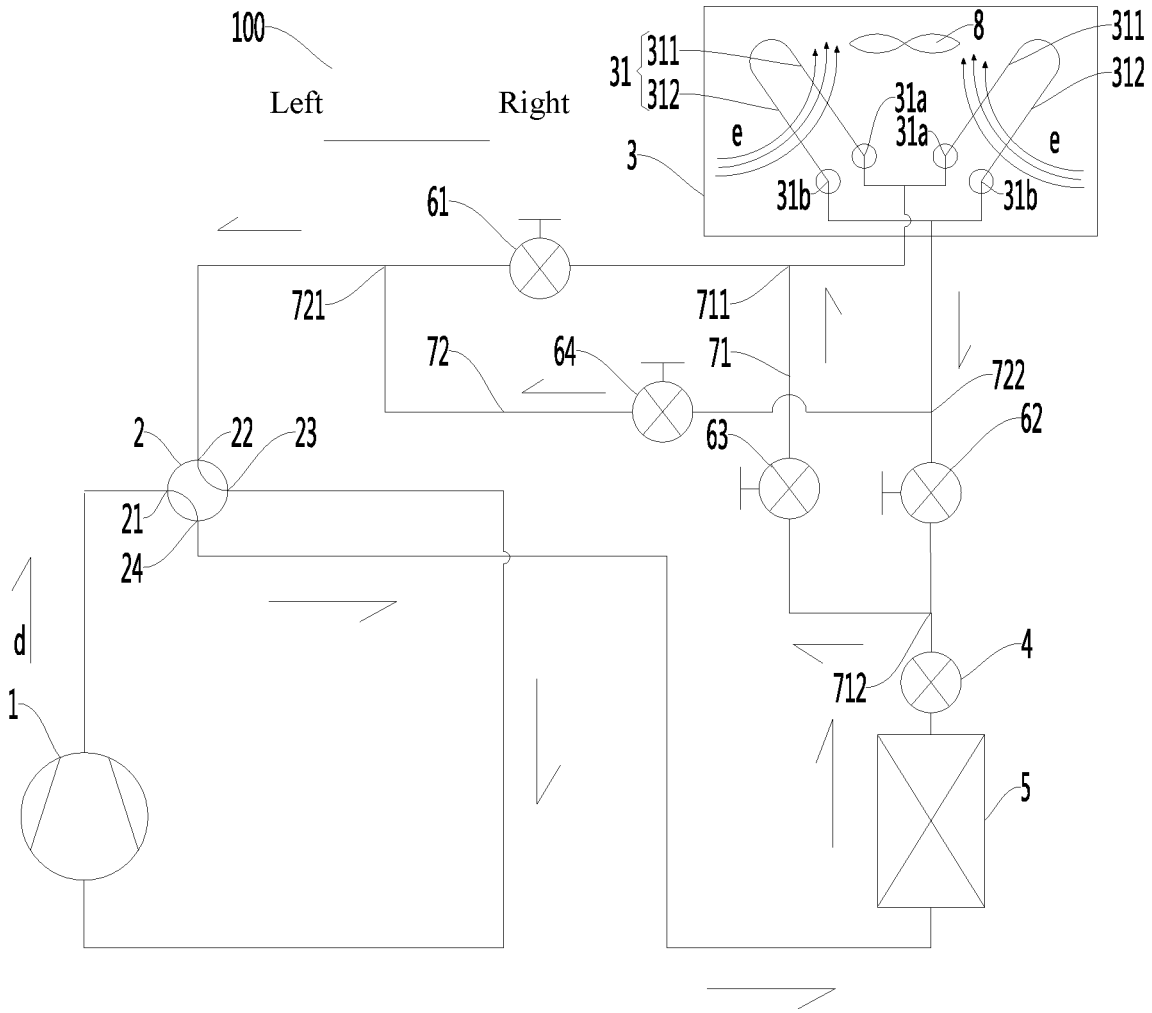
FIG. 4 is a principle diagram of a heat pump system in a heating mode according to embodiments of the present disclosure.
Figure 5:
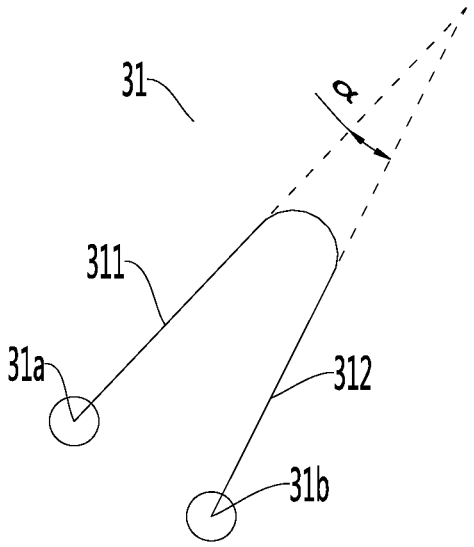
FIG. 5 is a schematic view of a double-rowed heat exchanger of a heat pump system according to embodiments of the present disclosure.

As illustrated in FIGS. 3-5, the heat pump system 100 according to embodiments of the present disclosure includes a compressor 1, a four-way valve 2, an outdoor heat exchanger 3, a throttling device 4 and an indoor heat exchanger 5 connected in sequence to form a refrigerant main circuit.

It could be understood by those skilled in the art that the compressor 1 may have an air inlet and an air outlet, the refrigerant enters the compressor 1 through the air inlet and is discharged out of the compressor 1 through the air outlet. The four-way valve 2 may have a first port 21, a second port 22, a third port 23 and a fourth port 24, the first port 21 is communicated with the air outlet, the second port 22 is communicated with the outdoor heat exchanger 3, the third port 23 is communicated with the air inlet, and the fourth port 24 is communicated with the indoor heat exchanger 5.

Specifically, the outdoor heat exchanger 3 includes at least one double-rowed heat exchanger 31. The double-rowed heat exchanger 31 includes a first heat exchanger 311 and a second heat exchanger 312 connected in series with each other. An included angle $\alpha$ between the first heat exchanger 311 and the second heat exchanger 312 is larger than or equal to 0 degree and smaller than 180 degrees. For example, as illustrated in FIGS. 3-4, the outdoor heat exchanger 3 includes two double-rowed heat exchangers 31, and each double-rowed heat exchanger 31 includes the first heat exchanger 311 and the second heat exchanger 312 connected in series with each other. The first heat exchanger 311 is arranged to be parallel to the second heat exchanger 312, i.e., the angle $\alpha$ equals to 0 degree. The double-rowed heat exchanger 31 at a left side and the double-rowed heat exchanger 31 at a right side are connected in parallel, and the refrigerant flows into the outdoor heat exchanger 3 through the two first heat exchangers 311 at the same time, and flows out of the outdoor heat exchanger 3 through the two second heat exchangers 312.

It could be understood that, as illustrated in FIG. 5, the first heat exchanger 311 may also be arranged to be not parallel to the second heat exchanger 312, i.e., the angle α may be larger than 0 degree and smaller than 180 degrees. It can also be understood that, the refrigerant may also flow into the outdoor heat exchanger 3 through the two second heat exchangers 312 at the same time, and flow out of the outdoor heat exchanger 3 through the two first heat exchangers 311.

The heat pump system 100 has the cooling mode and the heating mode, and the cooling mode and the heating mode are switched through the four-way valve 2. The heat pump system 100 further includes a switching unit. The switching unit is connected in the refrigerant main circuit, so as to switch the flow direction of the refrigerant, such that the refrigerant can flow into the outdoor heat exchanger 3 through one of the first heat exchanger 311 and the second heat exchanger 312, and flow out of the outdoor heat exchanger 3 through the other one of the first heat exchanger 311 and the second heat exchanger 312 both in the cooling mode and in the heating mode. For example, the refrigerant flows into the outdoor heat exchanger 3 through the first heat exchanger 311 and flows out of the outdoor heat exchanger 3 through the second heat exchanger 312 both in the cooling mode and in the heating mode. Thus, the heat pump system 100 can achieve the countercurrent flow heat exchange between the air and the refrigerant both in the cooling mode and in the heating mode.

Specifically, as illustrated in FIG. 3, when the heat pump system operates in the cooling mode, the first port 21 of the four-way valve 2 is communicated with the second port 22 of the four-way valve 2, and the third port 23 of the four-way valve 2 is communicated with the fourth port 24 of the four-way valve 2, that is, the four-way valve 2 controls the refrigerant to flow from the compressor 1 to the outdoor heat exchanger 3, and the switching unit controls the refrigerant to flow through the two first heat exchangers 311 into the outdoor heat exchanger 3 respectively, and to flow out of the outdoor heat exchanger 3 through the two second heat exchangers 312 respectively. Then, the refrigerant flows through the throttling device 4 and the indoor heat exchanger 5 successively. Finally, the four-way valve 2 controls the refrigerant flowing out of the indoor heat exchanger 5 to flow into the compressor 1 again. That is, a flow circuit of the refrigerant is shown as follows: compressor 1→four-way valve 2→first heat exchanger 311→second heat exchanger 312→throttling device 4→indoor heat exchanger 5→four-way valve 2→compressor 1, which is repeated in this way. In the drawings, an arrow d denotes a flow path of the refrigerant, an arrow e is used for denoting a flow direction of the air, and the flow direction of the refrigerant in the outdoor heat exchanger 3 is opposite to the flow direction of the air.

As illustrated in FIG. 4, when the heat pump system 100 operates in the heating mode, the first port 21 of the four-way valve 2 is communicated with the fourth port 24 of the four-way valve 2, and the second port 22 of the four-way valve 2 is communicated with the third port 23 of the four-way valve 2, that is, the four-way valve 2 controls the refrigerant to flow from the compressor 1 into the indoor heat exchanger 5 and the throttling device 4 successively. Then, the switching unit controls the refrigerant to flow into the outdoor heat exchanger 3 through the two first heat exchangers 311 respectively, and to flow out of the outdoor heat exchanger 3 through the two second heat exchangers 312 respectively. Finally, the four-way valve 2 controls the refrigerant to flow into the compressor 1. That is, the flow loop of the refrigerant is shown as follows: compressor 1→four-way valve 2→indoor heat exchanger 5→throttling device 4→first heat exchanger 311→second heat exchanger 312→four-way valve 2→compressor 1, which is repeated in this way. In the drawings, the arrow d denotes the flow path of the refrigerant, the arrow e is used for denoting the flow direction of the air, and the flow direction of the refrigerant in the outdoor heat exchanger 3 is opposite to the flow direction of the air.

From the above, no matter whether in the cooling mode or in the heating mode, the refrigerant flows into the outdoor heat exchanger 3 through the first heat exchanger 311 firstly, and then flows out of the outdoor heat exchanger 3 through the second heat exchanger 312. Moreover, the flow direction of the air is always constant (always being opposite to the flow direction of the refrigerant); therefore, both in the cooling mode and in heating mode, the countercurrent flow heat exchange between the air and the refrigerant is provided.

The heat pump system 100 according to embodiments of the present disclosure uses the switching unit to control the flow direction of the refrigerant, such that the refrigerant can flow into the outdoor heat exchanger 3 through the first heat exchanger 311 and flow out of the outdoor heat exchanger 3 through the second heat exchanger 312 both in the cooling mode and in the heating mode. Thus, both in the cooling mode and in the heating mode, there exists the countercurrent flow heat exchange between the refrigerant in the outdoor heat exchanger 3 and the air, thus improving the heat exchange efficiency of the outdoor heat exchanger 3, ensuring the heat exchange effects of the heat pump system 100 to be optimal both in the cooling mode and in the heating mode, and thereby improving the properties of the heat pump system 100.

In addition, when operating in a frosting condition, the first heat exchanger 311 in the double-rowed heat exchanger 31 is seriously frosted. The heat pump system 100 according to embodiments of the present disclosure can ensure that heat enters the first heat exchanger 311 preferentially in a defrosting mode, thus accelerating the melting of frost, and reducing the defrosting time. For example, in the heating mode, the gas-liquid two-phase refrigerant enters the outdoor heat exchanger 3 through the first heat exchanger 311, and after entering in the defrosting mode, the high temperature refrigerant enters the outdoor heat exchanger 3 through the first heat exchanger 311 firstly, such that the frost of the first heat exchanger 311 may be heated to melt firstly, thereby shortening the frosting time.

Preferably, the indoor heat exchanger 5 and the outdoor heat exchanger 3 both can be a parallel flow micro-channel heat exchanger, such that the heat pump system 100 can have a more compact structure and better heat exchange properties.

As illustrated in FIGS. 3-5, according to some embodiments of the present disclosure, the double-rowed heat exchanger 31 may be formed by connecting two heat exchangers in series, or the double-rowed heat exchanger 31 may also be formed by bending a single heat exchanger, thus facilitating the production of the double-rowed heat exchanger 31 and providing the double-rowed heat exchanger 31 with a high structure strength.

According to some embodiments of the present disclosure, two or more than two double-rowed heat exchangers 31 may be provided and the two or more than two double-rowed heat exchangers 31 are connected in parallel to one another, such that the heat exchange effects of the outdoor heat exchanger 3 can be further enhanced and hence the heat exchange efficiency of the outdoor heat exchanger 3 can be further improved. For example, as illustrated in FIGS. 3-4, two double-rowed heat exchangers 31 are provided, the first heat exchanger 311 and the second heat exchanger 312 of each double-rowed heat exchanger 31 are connected in series, and the double-rowed heat exchangers 31 are connected in parallel to each other. Each double-rowed heat exchanger 31 has a first port 31*a* and a second port 31*b*, the first port 31*a* is provided to the first heat exchanger 311 and the second port 31*b* is provided to the second heat exchanger 312. The first ports 31*a* of the two double-rowed heat exchangers 31 are connected correspondingly, and the second ports 31*b* of the two double-rowed heat exchangers 31 are also connected correspondingly, such that the two double-rowed heat exchangers 31 are connected in parallel, the refrigerant flows into the two first heat exchangers 311 through the two first ports 31*a* respectively at the same time, and then flows out of the two second heat exchangers 312 through the two second ports 31*b* respectively.

In embodiments illustrated in FIGS. 3-4, the first heat exchanger 311 and the second heat exchanger 312 may be parallel to each other and spaced apart from each other, which is beneficial to improving a heat dissipation area of the outdoor heat exchanger 3.

As illustrated in FIGS. 3-4, according to some embodiments of the present disclosure, the switching unit may include a first on-off valve 61, a second on-off valve 62, a third on-off valve 63 and a fourth on-off valve 64.

Furthermore, as illustrated in FIGS. 3-4, the first on-off valve 61 is connected between the first port 31*a* of the first heat exchanger 311 and the second port 22 of the four-way valve 2, and the second on-off valve 62 is connected between the second port 31*b* of the second heat exchanger 312 and the throttling device 4. The third on-off valve 63 is disposed in a first refrigerant branch circuit 71, a first end 711 of the first refrigerant branch circuit 71 is connected between the first on-off valve 61 and the first port 31*a* of the first heat exchanger 311, and a second end 712 of the first refrigerant branch circuit 71 is connected between the second on-off valve 62 and the throttling device 4. The fourth on-off valve 64 is disposed in a second refrigerant branch circuit 72, a first end 721 of the second refrigerant branch circuit 72 is connected between the first on-off valve 61 and the second port 22 of the four-way valve 2, and a second end 722 of the second refrigerant branch circuit 72 is connected between the second on-off valve 62 and the second port 31*b* of the second heat exchanger 312.

For example, the first on-off valve 61 is connected between the first port 31*a* and the second port 22, the second on-off valve 62 is connected between the second port 31*b* and the throttling device 4, the third on-off valve 63 is disposed in the first refrigerant branch circuit 71, and the fourth on-off valve 64 is disposed in the second refrigerant branch circuit 72. The first end 711 of the first refrigerant branch circuit 71 is connected between the first on-off valve 61 and the first port 31*a*, and the second end 712 of the first refrigerant branch circuit 71 is connected between the second on-off valve 62 and the throttling device 4. The first end 721 of the second refrigerant branch circuit 72 is connected between the first on-off valve 61 and the second port 22, and the second end 722 of the second refrigerant branch circuit 72 is connected between the second on-off valve 62 and the second port 31*b*.

Specifically, as illustrated in FIG. 3, in the cooling mode, the first on-off valve 61 and the second on-off valve 62 are switched on, and the third on-off valve 63 and the fourth on-off valve 64 are switched off. That is, a circuit between the four-way valve 2 and the first heat exchanger 311 and a circuit between the second heat exchanger 312 and the throttling device 4 are turned on, and the first refrigerant branch circuit 71 and the second refrigerant branch circuit 72 are turned off, such that the refrigerant coming from the compressor 1 flows through the four-way valve 2 and the first on-off valve 61 successively, then flows into the outdoor heat exchanger 3 through the first heat exchanger 311 and flows out of the outdoor heat exchanger 3 through the second heat exchanger 312.

As illustrated in FIG. 4, in the heating mode, the first on-off valve 61 and the second on-off valve 62 are switched off, and the third on-off valve 63 and the fourth on-off valve 64 are switched on. That is, the first refrigerant branch circuit 71 and the second refrigerant branch circuit 72 are turned on, and a circuit between the first end 711 of the first refrigerant branch circuit 71 and the first end 721 of the second refrigerant branch circuit 72 as well as a circuit between the second end 712 of the first refrigerant branch circuit 71 and the second end 722 of the second refrigerant branch circuit 72 are turned off, such that the refrigerant coming from the compressor 1 flows through the four-way valve 2, the indoor heat exchanger 5 and the throttling device 4 successively, further flows to the first heat exchanger 311 through the first refrigerant branch circuit 71, then flows into the outdoor heat exchanger 3 through the first heat exchanger 311 and flows out of the outdoor heat exchanger 3 through the second heat exchanger 312.

Preferably, the first on-off valve 61, the second on-off valve 62, the third on-off valve 63 and the fourth on-off valve 64 all can be an electromagnetic valve, thus facilitating switching of the switching unit between the cooling mode and the heating mode, and enabling exact, rapid electronic control and high security.

The heat pump system 100 according to a specific embodiment of the present disclosure will be described in details with reference to the drawings. It could be understood that, the following descriptions are just explanatory, but should not be construed to limit the present disclosure.

As illustrated in FIGS. 3-5, the heat pump system 100 according to embodiments of the present disclosure includes the compressor 1, the four-way valve 2, the outdoor heat exchanger 3, the throttling device 4 and the indoor heat exchanger 5 connected in sequence to form the refrigerant main circuit.

The compressor 1 has the air inlet and the air outlet, the refrigerant enters the compressor 1 through the air inlet and is discharged out of the compressor 1 through the air outlet. The four-way valve 2 has the first port 21, the second port 22, the third port 23 and the fourth port 24, the first port 21 is communicated with the air outlet, the second port 22 is communicated with the outdoor heat exchanger 3, the third port 23 is communicated with the air inlet, and the fourth port 24 is communicated with the indoor heat exchanger 5. The indoor heat exchanger 5 and the outdoor heat exchanger 3 both are the parallel flow micro-channel heat exchanger. The outdoor heat exchanger 3 is provided with an air flow orientation component 8 (for example, a fan), so as to ensure the flow direction of the air to be presented as the arrow e.

Specifically, the outdoor heat exchanger 3 includes two double-rowed heat exchangers 31 connected in parallel, each double-rowed heat exchanger 31 is formed by bending a single heat exchanger and includes the first heat exchanger 311 and the second heat exchanger 312 connected in series with each other. The included angle $\alpha$ between the first heat exchanger 311 and the second heat exchanger 312 equals to 0 degree, that is, the first heat exchanger 311 and the second heat exchanger 312 are parallel to each other and spaced apart from each other. Each double-rowed heat exchanger 31 has the first port 31*a* and the second port 31*b*, the first port 31*a* is provided to the first heat exchanger 311 and the second port 31*b* is provided to the second heat exchanger 312. The first port 31*a* of the double-rowed heat exchanger 31 at the left side is communicated with the first port 31*a* of the double-rowed heat exchanger 31 at the right side, and the second port 31*b* of the double-rowed heat exchanger 31 at the left side is communicated with the second port 31*b* of the double-rowed heat exchanger 31 at the right side, such that the two double-rowed heat exchangers 31 are connected in parallel.

The heat pump system 100 has the cooling mode and the heating mode, and the heat pump system 100 further includes the switching unit. The switching unit is connected in the refrigerant main circuit, so as to switch the flow direction of the refrigerant, such that the refrigerant flows into the outdoor heat exchanger 3 through the first heat exchanger 311, and flows out of the outdoor heat exchanger 3 through the second heat exchanger 312 both in the cooling mode and in the heating mode. Specifically, the switching unit includes the first on-off valve 61, the second on-off valve 62, the third on-off valve 63 and the fourth on-off valve 64. The first on-off valve 61, the second on-off valve 62, the third on-off valve 63 and the fourth on-off valve 64 all are an electromagnetic valve. The first on-off valve 61 is connected between the first port 31*a* and the second port 22, the second on-off valve 62 is connected between the second port 31*b* and the throttling device 4, the third on-off valve 63 is disposed in the first refrigerant branch circuit 71 and the fourth on-off valve 64 is disposed in the second refrigerant branch circuit 72. The first end 711 of the first refrigerant branch circuit 71 is connected between the first on-off valve 61 and the first port 31*a*, and the second end 712 of the first refrigerant branch circuit 71 is connected between the second on-off valve 62 and the throttling device 4. The first end 721 of the second refrigerant branch circuit 72 is connected between the first on-off valve 61 and the second port 22, and the second end 722 of the second refrigerant branch circuit 72 is connected between the second on-off valve 62 and the second port 31*b*.

As illustrated in FIG. 3, in the cooling mode, the first port 21 is communicated with the second port 22, the third port 23 is communicated with the fourth port 24, the first on-off valve 61 and the second on-off valve 62 are switched on, and the third on-off valve 63 and the fourth on-off valve 64 are switched off. Thus, the refrigerant is discharged from the air outlet of the compressor 1, flows through the first port 21, the second port 22 and the first on-off valve 61 successively, then flows into the outdoor heat exchanger 3 through the first ports 31*a* of the two double-rowed heat exchangers 31, and flows out of the outdoor heat exchanger 3 through the second ports 31*b* of the two double-rowed heat exchangers 31. Then, the refrigerant flows through the second on-off valve 62, the throttling device 4, the indoor heat exchanger 5, the fourth port 24 and the third port 23 successively, and finally flows into the compressor 1 through the air inlet. That is, the flow circuit of the refrigerant is shown as follows: compressor 1→four-way valve 2→first on-off valve 61→first heat exchanger 311→second heat exchanger 312→throttling device 4→indoor heat exchanger 5→four-way valve 2→compressor 1, which is repeated in this way. In the drawings, the arrow d denotes the flow path of the refrigerant, the arrow e is used for denoting the flow direction of the air, and the flow direction of the refrigerant in the outdoor heat exchanger 3 is opposite to the flow direction of the air.

As illustrated in FIG. 4, in the heating mode, the first port 21 is communicated with the fourth port 24, the second port 22 is communicated with the third port 23, the first on-off valve 61 and the second on-off valve 62 are switched off, and the third on-off valve 63 and the fourth on-off valve 64 are switched on. Thus, the refrigerant is discharged from the air outlet of the compressor 1, flows through the first port 21, the fourth port 24, the indoor heat exchanger 5 and the throttling device 4 successively, further flows into the first refrigerant branch circuit 71 and flows through the third on-off valve 63. Then, the refrigerant flows into the outdoor heat exchanger 3 through the first ports 31*a* of the two double-rowed heat exchangers 31, flows out of the outdoor heat exchanger 3 through the second ports 31*b* of the two double-rowed heat exchangers 31, then flows into the second refrigerant branch circuit 72 and flows through the fourth on-off valve 64. Finally, the refrigerant flows through the second port 22 and the third port 23 successively, and further flows into the compressor 1 through the air inlet. That is, the flow circuit of the refrigerant is shown as follows: compressor 1→four-way valve 2→indoor heat exchanger 5→throttling device 4→third on-off valve 63→first heat exchanger 311→second heat exchanger 312→fourth on-off valve 64→four-way valve 2→compressor 1, which is repeated in this way. In the drawings, the arrow d denotes the flow path of the refrigerant, the arrow e is used for denoting the flow direction of the air, and the flow direction of the refrigerant in the outdoor heat exchanger 3 is opposite to the flow direction of the air.

The heat pump system 100 according to embodiments of the present disclosure uses the switching unit to control the flow direction of the refrigerant in the outdoor heat exchanger 3, and thus enables the flow direction of the refrigerant in the outdoor heat exchanger 3 to be opposite to the flow direction of the air both in the cooling mode and in the heating mode, i.e., there exists the countercurrent flow heat exchange between the refrigerant in the outdoor heat exchanger 3 and the air both in the cooling mode and in the heating mode, thereby ensuring the heat exchange effects of the outdoor heat exchanger 3 to be optimal both in the cooling mode and in the heating mode, and improving the properties of the heat pump system 100.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as illustrated in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been illustrated and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A heat pump system, comprising a compressor, a four-way valve, an outdoor heat exchanger, a throttling device and an indoor heat exchanger connected in sequence to form a refrigerant main circuit, wherein the outdoor heat exchanger includes at least two double-rowed heat exchangers, each double-rowed heat exchanger comprises a first heat exchanger and a second heat exchanger connected in series with each other, the first heat exchanger has a refrigerant inlet, the second heat exchanger has a refrigerant outlet, and an included angle $\alpha$ between the first heat exchanger and the second heat exchanger is larger than or equal to 0 degree and smaller than 180 degrees;

the heat pump system has a cooling mode and a heating mode, and further includes switching unit, the switching unit is connected in the refrigerant main circuit, and switches a flow direction of a refrigerant, the switching unit comprises first to four valves, the first valve and the third valve are connected to the refrigerant inlet, the second valve and the fourth valve are connected to the refrigerant outlet, wherein the refrigerant flows into the outdoor heat exchanger through the refrigerant inlet after passing through one of the first valve and the third valve, and flows out of the outdoor heat exchanger through the refrigerant outlet and further passes through one of the second valve and the fourth valve in the cooling mode, wherein the refrigerant flows into the outdoor heat exchanger through the refrigerant inlet after passing through the other one of the first valve and the third valve, and flows out of the outdoor heat exchanger through the refrigerant outlet and further passes through the other one of the second valve and the fourth valve in the heating mode.

2. The heat pump system as set forth in claim 1, wherein the double-rowed heat exchanger is formed by bending a single heat exchanger, or by connecting two heat exchangers in series.

3. The heat pump system as set forth in claim 1, wherein two or more than two double-rowed heat exchangers are provided and the two or more than two double-rowed heat exchangers are connected in parallel to each other.

4. The heat pump system as set forth in claim 1, wherein the indoor heat exchanger and the outdoor heat exchanger each are a parallel flow micro-channel heat exchanger.

5. The heat pump system as set forth in claim 1, wherein the first heat exchanger and the second heat exchanger are parallel to each other and spaced apart from each other.

6. The heat pump system as set forth in claim 1, wherein the on-off valve comprises a first on-off valve, a second on-off valve, a third on-off valve and a fourth on-off valve.

7. The heat pump system as set forth in claim 6, wherein the first on-off valve is connected between the first heat exchanger and the four-way valve, the second on-off valve is connected between the second heat exchanger and the throttling device, the third on-off valve is disposed in a first refrigerant branch circuit, a first end of the first refrigerant branch circuit is connected between the first on-off valve and the first heat exchanger, and a second end of the first refrigerant branch circuit is connected between the second on-off valve and the throttling device, the fourth on-off valve is disposed in a second refrigerant branch circuit, a first end of the second refrigerant branch circuit is connected between the first on-off valve and the four-way valve, and a second end of the second refrigerant branch circuit is connected between the second on-off valve and the second heat exchanger.

8. The heat pump system as set forth in claim 7, wherein the first on-off valve, the second on-off valve, the third on-off valve and the fourth on-off valve each are an electromagnetic valve.

9. The heat pump system as set forth in claim 7, wherein the first on-off valve and the second on-off valve are switched on in the cooling mode, and the third on-off valve and the fourth on-off valve are switched off in the cooling mode.

10. The heat pump system as set forth in claim 7, wherein the first on-off valve and the second on-off valve are switched off in the heating mode, and the third on-off valve and the fourth on-off valve are switched on in the heating mode.

11. The heat pump system as set forth in claim 8, wherein the first on-off valve and the second on-off valve are switched on in the cooling mode, and the third on-off valve and the fourth on-off valve are switched off in the cooling mode.

12. The heat pump system as set forth in claim 8, wherein the first on-off valve and the second on-off valve are switched off in the heating mode, and the third on-off valve and the fourth on-off valve are switched on in the heating mode.

13. The heat pump system as set forth in claim 9, wherein the first on-off valve and the second on-off valve are switched off in the heating mode, and the third on-off valve and the fourth on-off valve are switched on in the heating mode.

14. The heat pump system as set forth in claim 2, wherein the switching unit comprises a first on-off valve, a second, a third on-off valve and a fourth on-off valve.

15. The heat pump system as set forth in claim 3, wherein the switching unit comprises a first on-off valve, a second on-off valve, a third on-off valve and a fourth on-off valve.

16. The heat pump system as set forth in claim 4, wherein the switching unit comprises a first on-off valve, a second on-off valve, a third on-off valve and a fourth on-off valve.

17. The heat pump system as set forth in claim 5, wherein the switching unit comprises a first on-off valve, a second on-off valve, a third on-off valve and a fourth on-off valve.

18. The heat pump system as set forth in claim 14, wherein the first on-off valve is connected between the first heat exchanger and the four-way valve, the second on-off valve is connected between the second heat exchanger and the throttling device, the third on-off valve is disposed in a first refrigerant branch circuit, a first end of the first refrigerant branch circuit is connected between the first on-off valve and the first heat exchanger, and a second end of the first refrigerant branch circuit is connected between the second on-off valve and the throttling device, the fourth on-off valve is disposed in a second refrigerant branch circuit, a first end of the second refrigerant branch circuit is connected between the first on-off valve and the four-way valve, and a second end of the second refrigerant branch circuit is connected between the second on-off valve and the second heat exchanger.

19. The heat pump system as set forth in claim 15, wherein the first on-off valve is connected between the first heat exchanger and the four-way valve, the second on-off valve is connected between the second heat exchanger and the throttling device, the third on-off valve is disposed in a first refrigerant branch circuit, a first end of the first refrigerant branch circuit is connected between the first on-off valve and the first heat exchanger, and a second end of the first refrigerant branch circuit is connected between the second on-off valve and the throttling device, the fourth on-off valve is disposed in a second refrigerant branch circuit, a first end of the second refrigerant branch circuit is connected between the first on-off valve and the four-way valve, and a second end of the second refrigerant branch circuit is connected between the second on-off valve and the second heat exchanger.

20. A heat pump system, comprising a compressor, a four-way valve, an outdoor heat exchanger, a throttling device and an indoor heat exchanger connected in sequence to form a refrigerant main circuit, wherein the outdoor heat exchanger comprises at least one double-rowed heat exchanger, the double-rowed heat exchanger comprises a first heat exchanger and a second heat exchanger connected in series with each other, and an included angle $\alpha$ between the first heat exchanger and the second heat exchanger is larger than or equal to 0 degree and smaller than 180 degrees;

the heat pump system has a cooling mode and a heating mode, and further comprises an on-off valve, the on-off valve is connected in the refrigerant main circuit, and configured to switch a flow direction of a refrigerant, such that the refrigerant flows into the outdoor heat exchanger through a first one of the first heat exchanger and the second heat exchanger, and flows out of the outdoor heat exchanger through a second one of the first heat exchanger and the second heat exchanger both in the cooling mode and in the heating mode, wherein the on-off valve comprises:

a first on-off valve connected between the first heat exchanger and the four-way valve;

a second on-off valve connected between the second heat exchanger and the throttling device;

a third on-off valve disposed in a first refrigerant branch circuit, the first refrigerant branch circuit comprising a first end connected between the first on-off valve and the first heat exchanger, and a second end connected between the second on-off valve and the throttling device; and a fourth on-off valve disposed in a second refrigerant branch circuit, the second refrigerant branch circuit comprising a first end connected between the first on-off valve and the four-way valve, and a second end connected between the second on-off valve and the second heat exchanger.

* * * * *